US011276968B2

(12) United States Patent
Nobukuni et al.

(10) Patent No.: US 11,276,968 B2
(45) Date of Patent: Mar. 15, 2022

(54) CONNECTOR

(71) Applicant: SUMITOMO WIRING SYSTEMS, LTD., Mie (JP)

(72) Inventors: Takashi Nobukuni, Mie (JP); Yuichi Goto, Mie (JP)

(73) Assignee: SUMITOMO WIRING SYSTEMS, LTD., Mie (JP)

( * ) Notice: Subject to any disclaimer, the term of this patent is extended or adjusted under 35 U.S.C. 154(b) by 0 days.

(21) Appl. No.: 16/980,193

(22) PCT Filed: Nov. 19, 2019

(86) PCT No.: PCT/JP2019/045170
§ 371 (c)(1),
(2) Date: Sep. 11, 2020

(87) PCT Pub. No.: WO2020/116145
PCT Pub. Date: Jun. 11, 2020

(65) Prior Publication Data

US 2021/0013683 A1 Jan. 14, 2021

(30) Foreign Application Priority Data

Dec. 5, 2018 (JP) ..... JP2018-228050
Jun. 17, 2019 (JP) ..... JP2019-111909

(51) Int. Cl.
*H01R 13/7193* (2011.01)

(52) U.S. Cl.
CPC ..... *H01R 13/7193* (2013.01)

(58) Field of Classification Search
None
See application file for complete search history.

(56) References Cited

U.S. PATENT DOCUMENTS 5,286,221 A 2/1994 Fencl et al.
5,415,569 A * 5/1995 Colleran ..... H01R 13/7195 439/620.16
8,690,607 B2 * 4/2014 Tsukamoto ..... H01R 13/7193 439/620.09
8,992,259 B2 * 3/2015 Miwa ..... H01R 13/506 439/620.05
2013/0303023 A1 11/2013 Miwa et al.

FOREIGN PATENT DOCUMENTS

JP S50-156789 U 12/1975
JP 2012-009325 A 1/2012

OTHER PUBLICATIONS

International Search Report dated Jan. 7, 2020 for WO 2020/116145 A1 (4 pages).

* cited by examiner

*Primary Examiner* — Felix O Figueroa
(74) *Attorney, Agent, or Firm* — Abelman, Frayne & Schwab

(57) ABSTRACT

A connector 110 is provided with a plurality of ferrites 114 and a housing 116 including a plurality of accommodating portions 139 capable of individually accommodating the plurality of ferrites 114 from a first direction. The plurality of accommodating portions 139 are disposed side by side in a second direction intersecting the first direction. Two intermediate walls 138 are disposed between the accommodating portions 139 adjacent in the second direction with a space S defined therebetween in a third direction intersecting the first and second directions.

9 Claims, 15 Drawing Sheets

CONNECTOR

CROSS REFERENCE TO RELATED APPLICATIONS

This application is a national phase of PCT application No. PCT/JP2019/045170, filed on 19 Nov. 2019, which claims priority from Japanese patent application Nos. 2018-228050 and 2019-111909 filed on 5 Dec. 2018 and 17 Jun. 2019, respectively, all of which are incorporated herein by reference.

TECHNICAL FIELD

A technique disclosed by this specification relates to a connector.

BACKGROUND

A connector described in Patent Document 1 below is known as an example of a conventional connector. This connector includes a housing provided with a plurality of connector fitting portions to be respectively fit to a plurality of mating connectors, a plurality of terminals mounted in the housing to project into the respective connector fitting portions, and a noise removing means constituted by a plurality of ferrites provided in the respective connector fitting portions.

The housing is provided with a plurality of frames, and the plurality of ferrites are located in the respective frames of the housing and held in the housing by a pair of biasing arms provided on the housing. Four corners of the ferrites are held by two projecting portions provided on the pair of biasing arms.

PRIOR ART DOCUMENT

Patent Document

Patent Document 1: JP 2012-069270A

SUMMARY OF THE INVENTION

Problems to be Solved

Since the four corners of the ferrites are held by the biasing arms in Patent Document 1, there is a concern that the ferrites adjacent to each other contact due to vibration or the like.

Means to Solve the Problem

The present disclosure is directed to a connector with a plurality of ferrites, and a housing including a plurality of accommodating portions capable of individually accommodating the plurality of ferrites from a first direction, wherein the plurality of accommodating portions are disposed side by side in a second direction intersecting the first direction, and two intermediate walls are disposed between the accommodating portions adjacent in the second direction with a space defined therebetween in a third direction intersecting the first and second directions.

Effect of the Invention

According to the connector disclosed in this specification, the mutual contact of the ferrites can be suppressed.

DETAILED DESCRIPTION TO EXECUTE THE INVENTION

First Embodiment

[Background Art]

Figure 1:
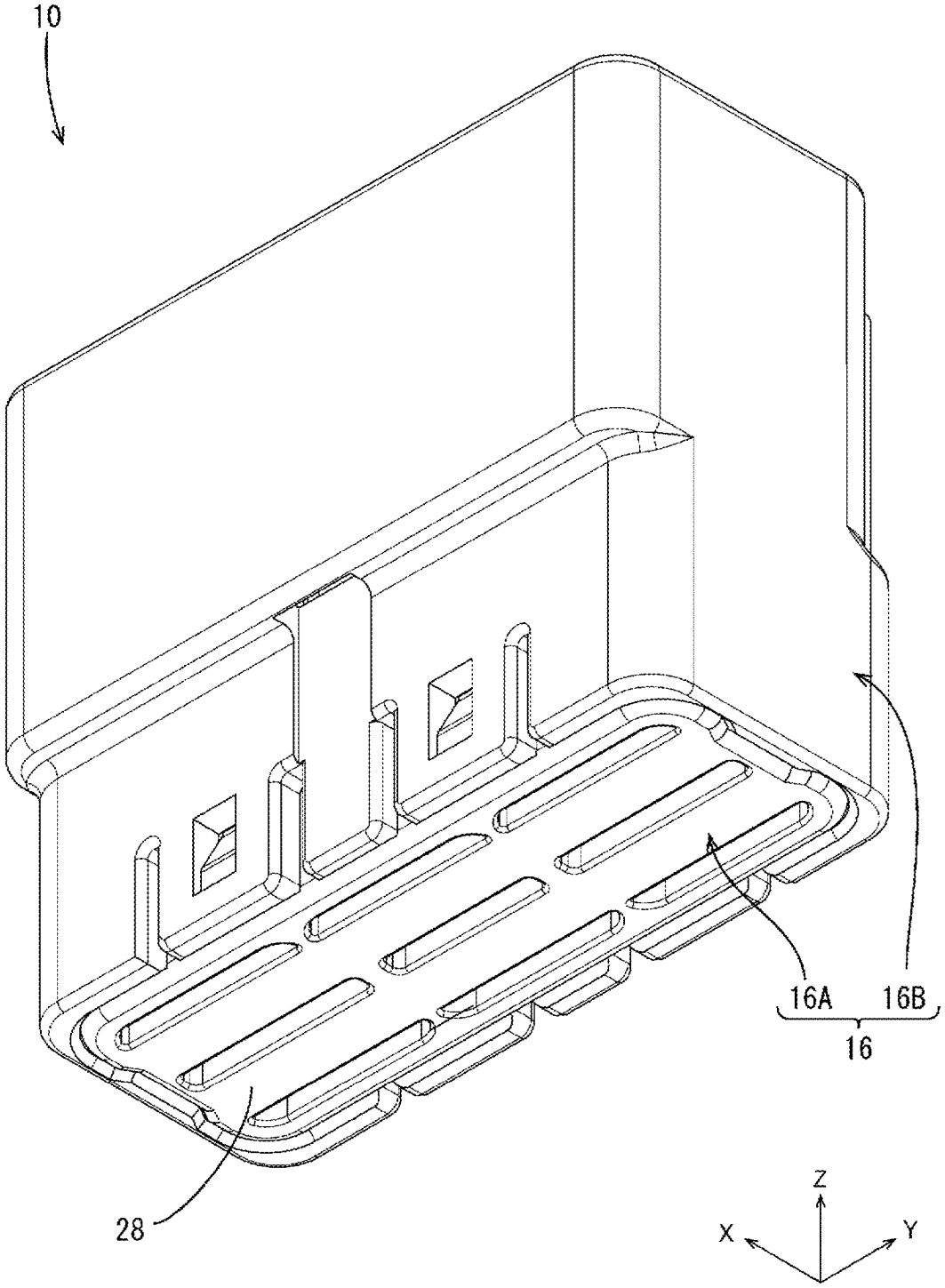
FIG. 1 is a perspective view of a connector in a first embodiment.

A connector described in Japanese Patent Laid-Open Publication No. 2012-069270 is, for example, known as an example of a conventional connector. This connector includes a housing provided with a plurality of connector fitting portions to be respectively fit to a plurality of mating connectors, a plurality of terminals mounted in the housing to project into the respective connector fitting portions, and a noise removing means constituted by a plurality of ferrites provided in the respective connector fitting portions.

The housing is provided with a plurality of frames, and the plurality of ferrites are located in the respective frames of the housing and held in the housing by a pair of biasing arms provided on the housing.

To mold the biasing arms of the housing, a slide mold structure is generally necessary. Further, if the ferrites are held by the biasing arms, properties of the ferrites may change due to the resilient contact of the biasing arms with the ferrites.

[Description of First Embodiment of Present Disclosure]

Embodiments of the present disclosure are listed and described.

(1) A connector of the present disclosure is provided with a plurality of ferrites each including rounded corner portions on four corners of an outer peripheral side surface, and a housing including a plurality of accommodating portions capable of individually accommodating the plurality of ferrites from a first direction, wherein the accommodating portion includes a bottom wall portion configured such that the ferrite is placed thereon, four facing wall portions facing the four corner portions of the ferrite, and a projection for holding the ferrite in the accommodating portion, the projection projects on at least one facing wall portion, out of the four facing wall portions, and the corner portion of the ferrite is biased by the projection when the ferrite is accommodated into the accommodating portion, and is not biased by the projection and located to be able to come into contact with the projection from the first direction in a state where the ferrite is accommodated in the accommodating portion.

When the ferrite is accommodated into the accommodating portion, the corner portion of the ferrite comes into contact with the projection if the ferrite is going to escape from the accommodating portion in the first direction since the corner portion of the ferrite is located to be able to come into contact with the projection from the first direction, whereby the escape of the ferrite in the first direction can be suppressed and the ferrite can be held in the accommodating portion. In this way, although the ferrite is conventionally held in the accommodating portion by the resilient contact of biasing arms with the ferrite, the ferrite can be held in the accommodating portion without using the biasing arms in the above configuration. Further, since the corner portion of the ferrite is not biased by the projection with the ferrite accommodated in the accommodating portion, changes in properties of the ferrite can be suppressed.

(2) Preferably, the projections are provided on all the four facing wall portions.

By providing the projections on all the four facing wall portions, the escape of the ferrite from the accommodating portion can be made less likely as compared to a configuration in which the projection is provided only on one facing wall portion.

(3) Preferably, the accommodating portion is in the form of a box open in the first direction and long in a second direction intersecting the first direction, the plurality of ferrites are disposed side by side in the second direction on the bottom wall portions of the accommodating portions, the accommodating portion further includes a first inner wall and a second inner wall facing in a third direction intersecting the first and second directions, and the facing wall portions on the first inner wall side and the facing wall portions on the second inner wall side facing the former facing wall portions are not connected.

Since a pair of the facing wall portions facing in the third direction are not connected, the housing can be reduced in size in the second direction as compared to a configuration in which a pair of adjacent ferrites are partitioned by facing wall portions.

[Details of First Embodiment of Present Disclosure]

A connector 10 in a first embodiment of the present disclosure is described below with reference to the drawings (FIGS. 1 to 10). Note that the present disclosure is not limited to these illustrations and is intended to be represented by claims and include all changes in the scope of claims and in the meaning and scope of equivalents. In the following description, an X direction shown in FIGS. 1 to 10 is referred to as a forward direction of a front-rear direction (third direction), a Y direction is referred to as a rightward direction of a lateral direction (second direction) and a Z direction is referred to as an upward direction of a vertical direction (first direction).

Figure 2:
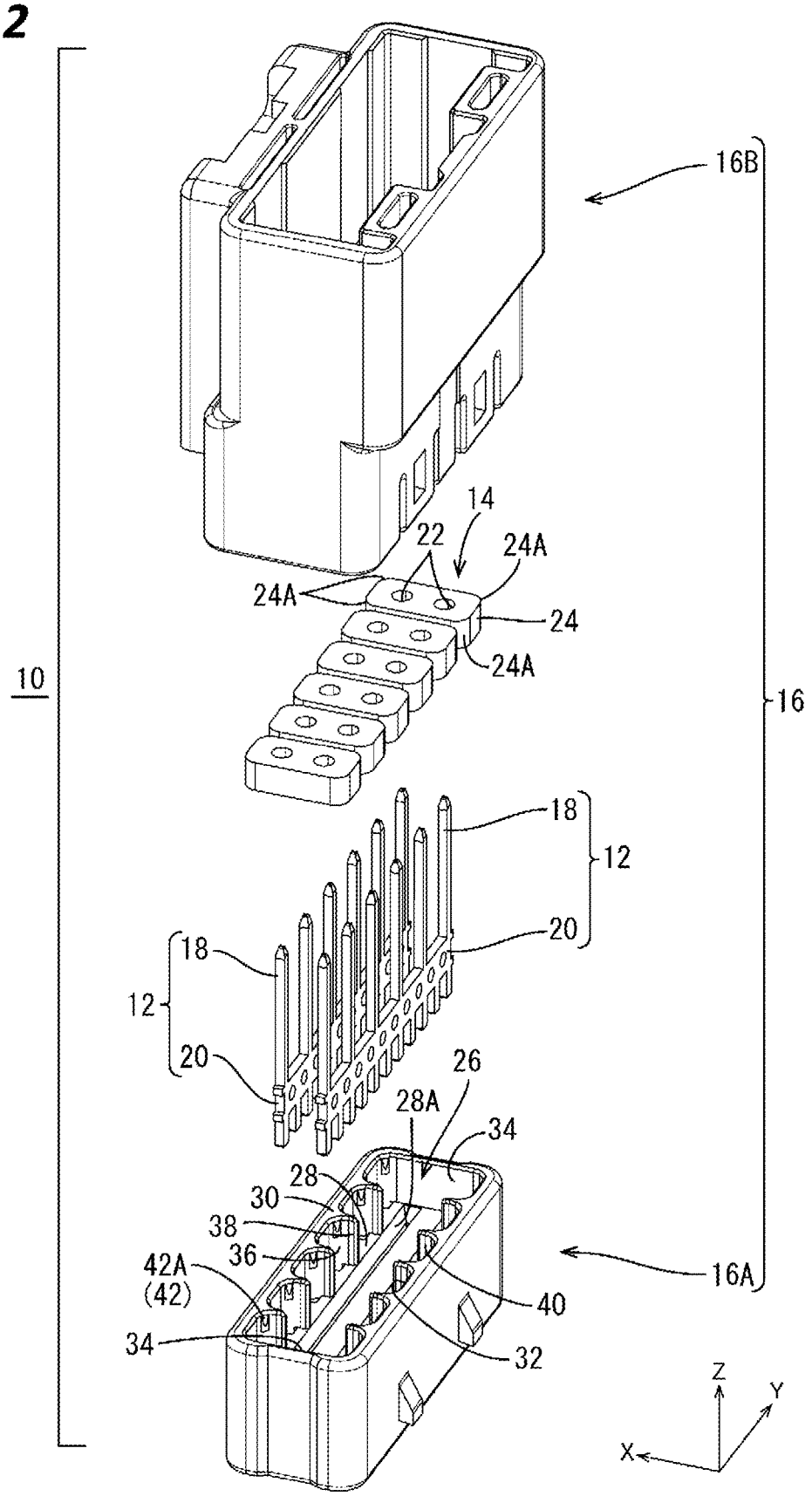
FIG. 2 is an exploded perspective view of the connector.

The connector 10 of the first embodiment is a joint connector for multiplex communication used in a vehicle and, as shown in FIG. 2, composed of two joint terminals 12, a plurality of (six) ferrites 14 for noise reduction and a housing 16.

The joint terminal 12 is made of conductive metal and, as shown in FIG. 2, composed of a plurality of (six) bar-like terminal body portions 18 projecting upward and a coupling portion 20 shaped to be long in the lateral direction and coupling lower end sides of the plurality of terminal body portions 18 to each other.

Figure 5:
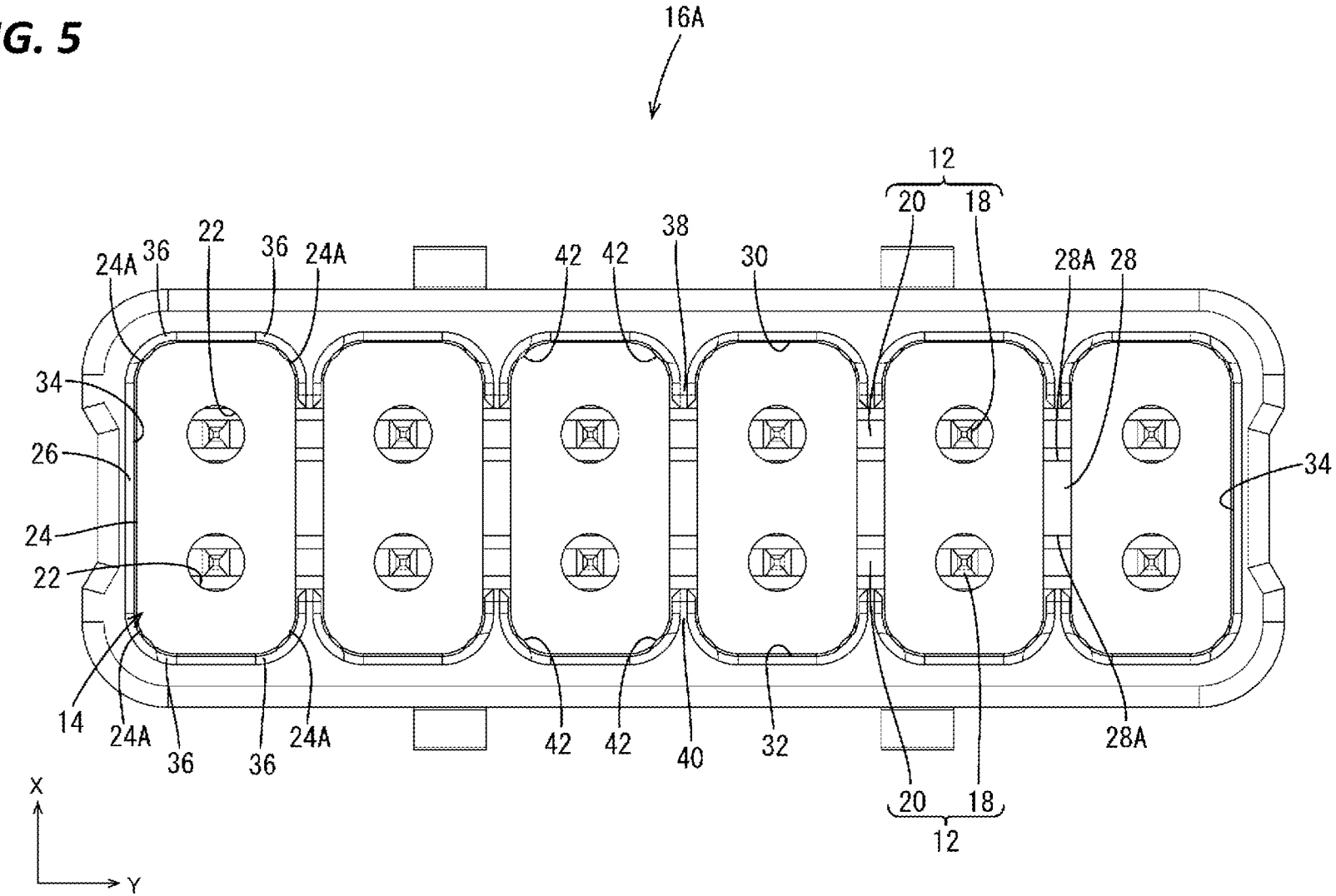
FIG. 5 is a plan view of the inner housing in the state where the ferrites are accommodated.
Figure 6:
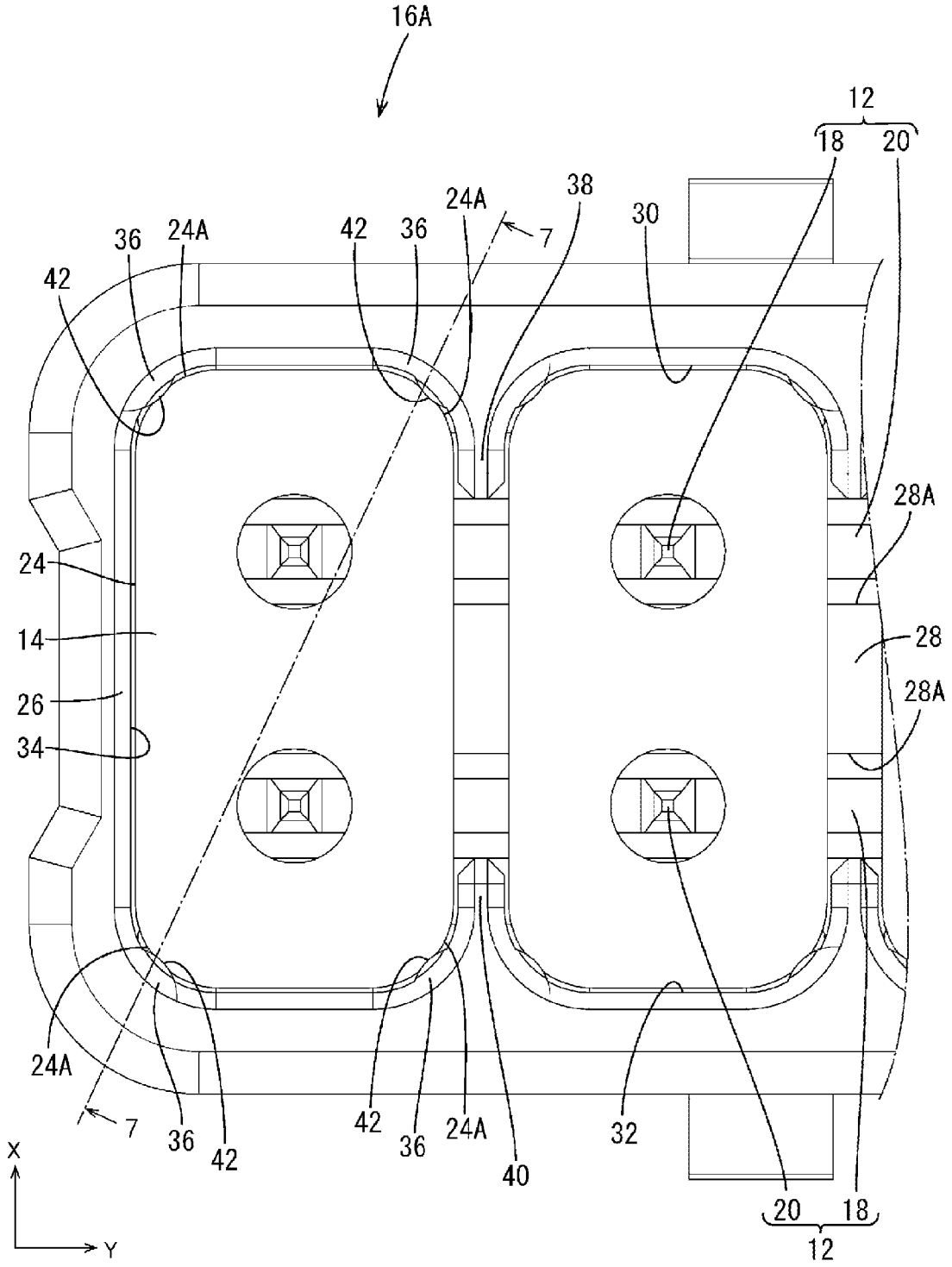
FIG. 6 is an enlarged view near the ferrites in FIG. 5.

As shown in FIGS. 5 and 6, the ferrite 14 has a rectangular shape and includes two insertion holes 22 provided to penetrate through upper and lower surfaces and rounded corner portions 24A provided on four corners of an outer peripheral side surface 24.

As shown in FIG. 2, the housing 16 is in the form of a box long in the lateral direction and composed of an inner housing (accommodating portion) 16A including an opening 26 opening upward and an outer housing 16B for accommodating the inner housing 16A. The plurality of ferrites 14 are individually accommodated inside the inner housing 16A as shown in FIG. 5.

Figure 3:
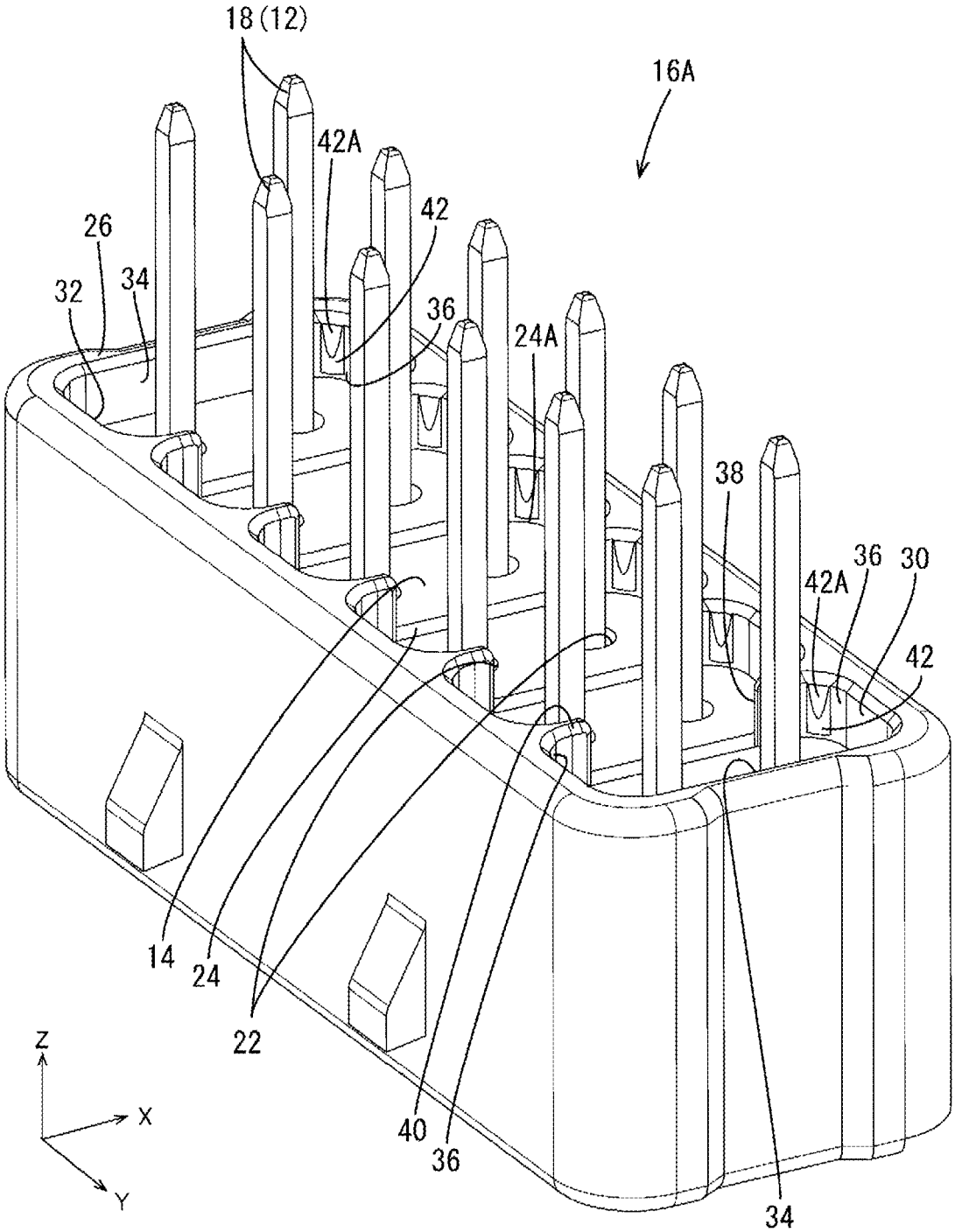
FIG. 3 is a perspective view of an inner housing in a state where ferrites are accommodated.

As shown in FIGS. 3 and 5, the inner housing 16A is shaped to be long in the lateral direction and includes a bottom wall portion 28, on which the plurality of ferrites 14 are placed side by side in the lateral direction, a first inner wall 30 projecting upward from a front end part of the bottom wall portion 28, a second inner wall 32 projecting upward from a rear end part of the bottom wall portion 28 and facing the first inner wall 30 in the front-rear direction, and a pair of third inner walls 34 projecting upward from both left and right end parts of the bottom wall portion 28 and facing each other in the lateral direction.

Figure 9:
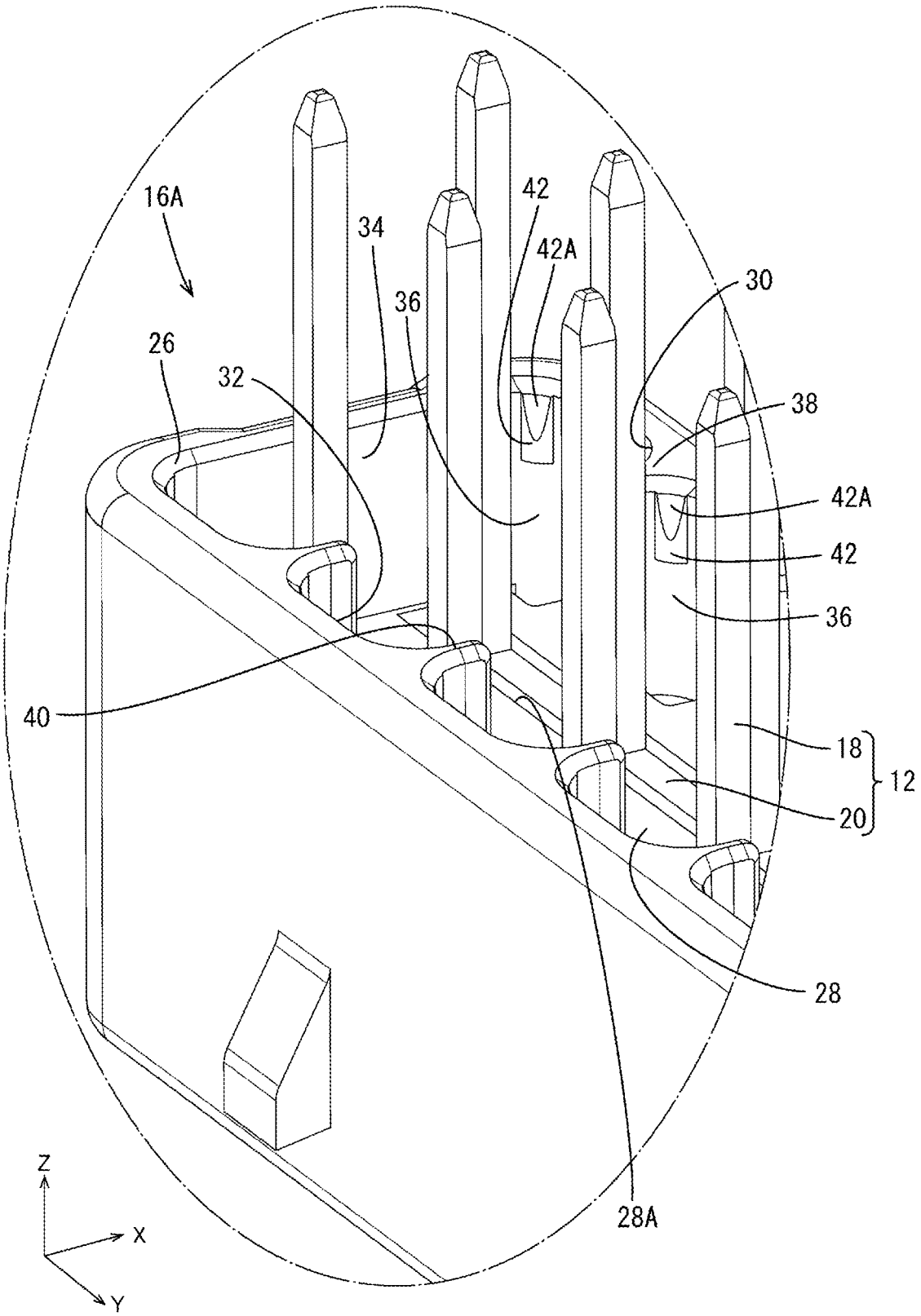
FIG. 9 is a perspective view of the inner housing in a state where the ferrites are not accommodated.
Figure 10:
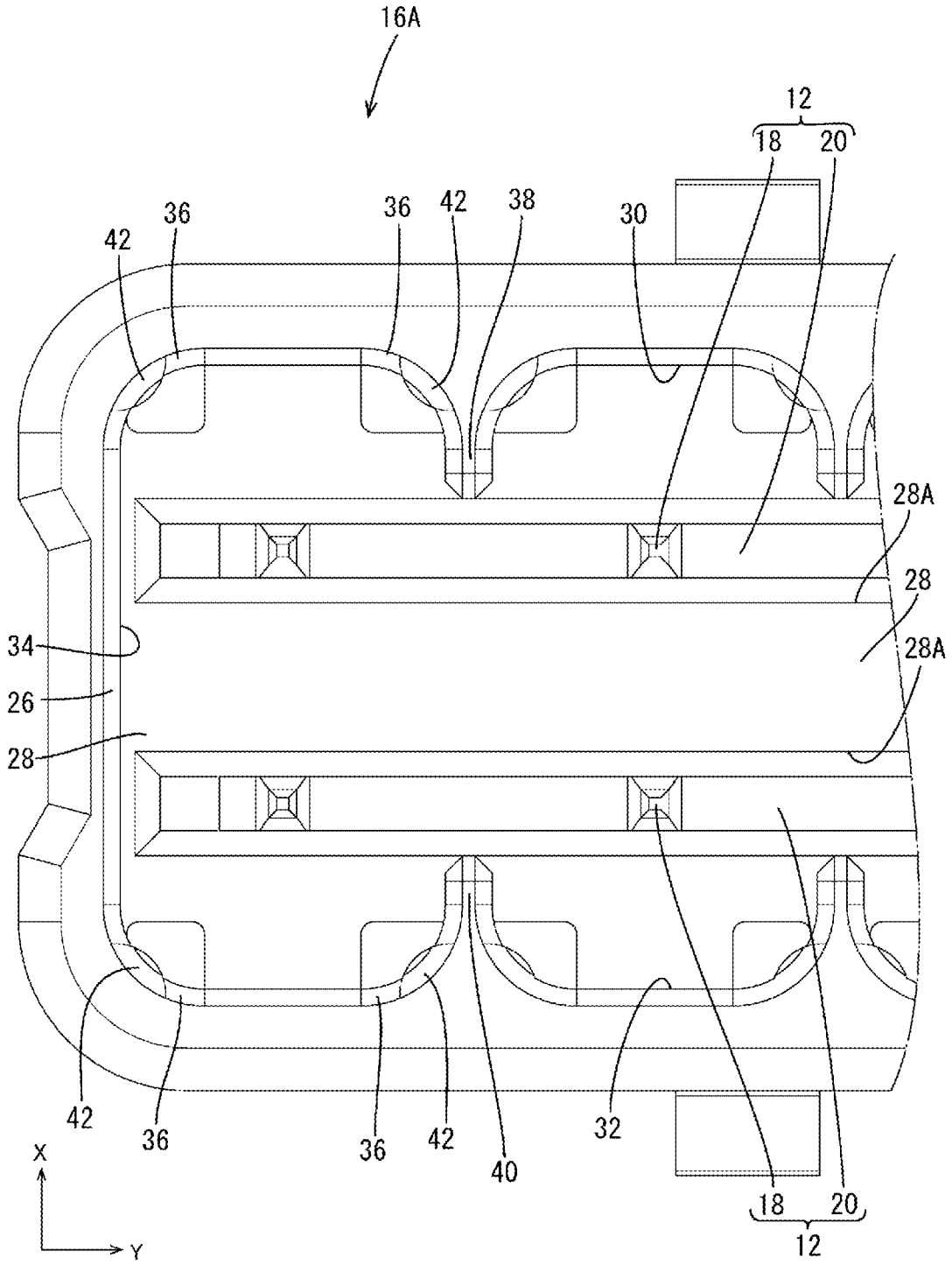
FIG. 10 is a plan view of the inner housing in the state where the ferrites are not accommodated.
Figure 11:
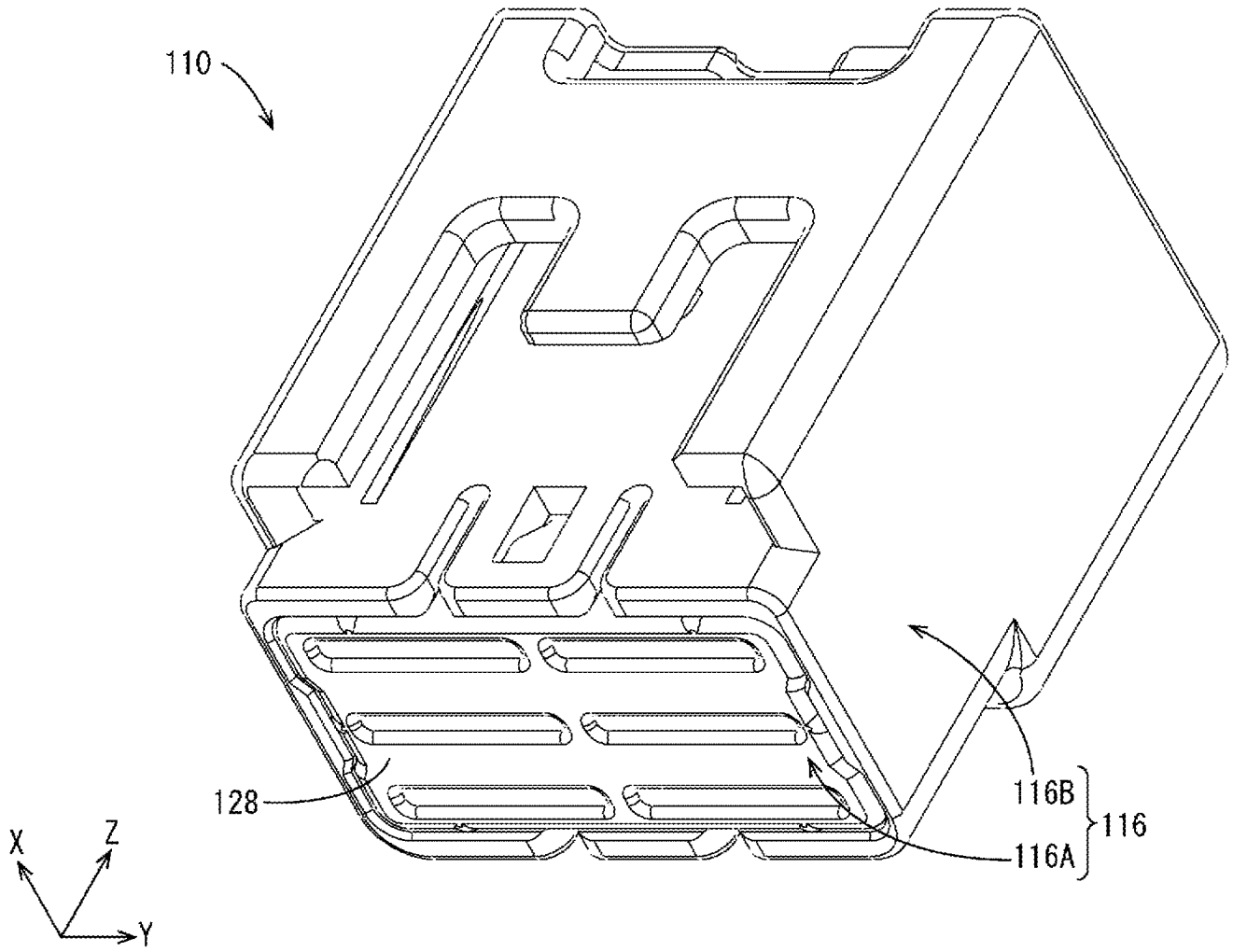
FIG. 11 is a perspective view of a connector in a second embodiment.

As shown in FIGS. 9 and 10, the bottom wall portion 28 is provided with a pair of front and rear groove portions 28A long in the lateral direction, and the coupling portions 20 of the two joint terminals 12 are respectively press-fit and held in the inner walls of the pair of groove portions 28A.

As shown in FIGS. 3 and 5, the first inner wall 30 is provided with first partitioning portions 38 each projecting toward a pair of the ferrites 14 adjacent in the lateral direction and partitioning between the pair of adjacent ferrites 14. On the other hand, the second inner wall 32 is provided with second partitioning portions 40 each projecting toward a pair of the ferrites 14 adjacent in the lateral direction and partitioning between the pair of adjacent ferrites 14. A plurality of the first partitioning portions 38 and a plurality of the second partitioning portions 40 are both provided at predetermined intervals in the lateral direction. The respective first partitioning portions 38 and the respective second partitioning portions 40 are arranged to face each other in the front-rear direction.

As shown in FIGS. 3 and 5, four facing wall portions 36 facing the corner portions 24A on the four corners of each of the plurality of ferrites 14 are provided inside the inner housing 16A. The facing wall portions 36 are respectively provided at positions of the first and second partitioning portions 38, 40 facing the corner portions 24A of the respective ferrites 14 (positions of the four corners in the inner housing 16A and facing the corner portions 24A of the ferrites 14).

As shown in FIGS. 3 and 5, the first partitioning portions 38 (and the facing wall portions 36 provided on the first partitioning portions 38) and the second partitioning portions 40 (and the facing wall portions 36 provided on the second partitioning portions 40) facing in the front-rear direction are not connected to each other, and adjacent accommodation spaces for the ferrites 14 communicate in the lateral direction. In this way, the housing 16 can be reduced in size in the lateral direction as compared to a configuration in which the pairs of adjacent ferrites 14 are partitioned by facing wall portions.

Figure 4:
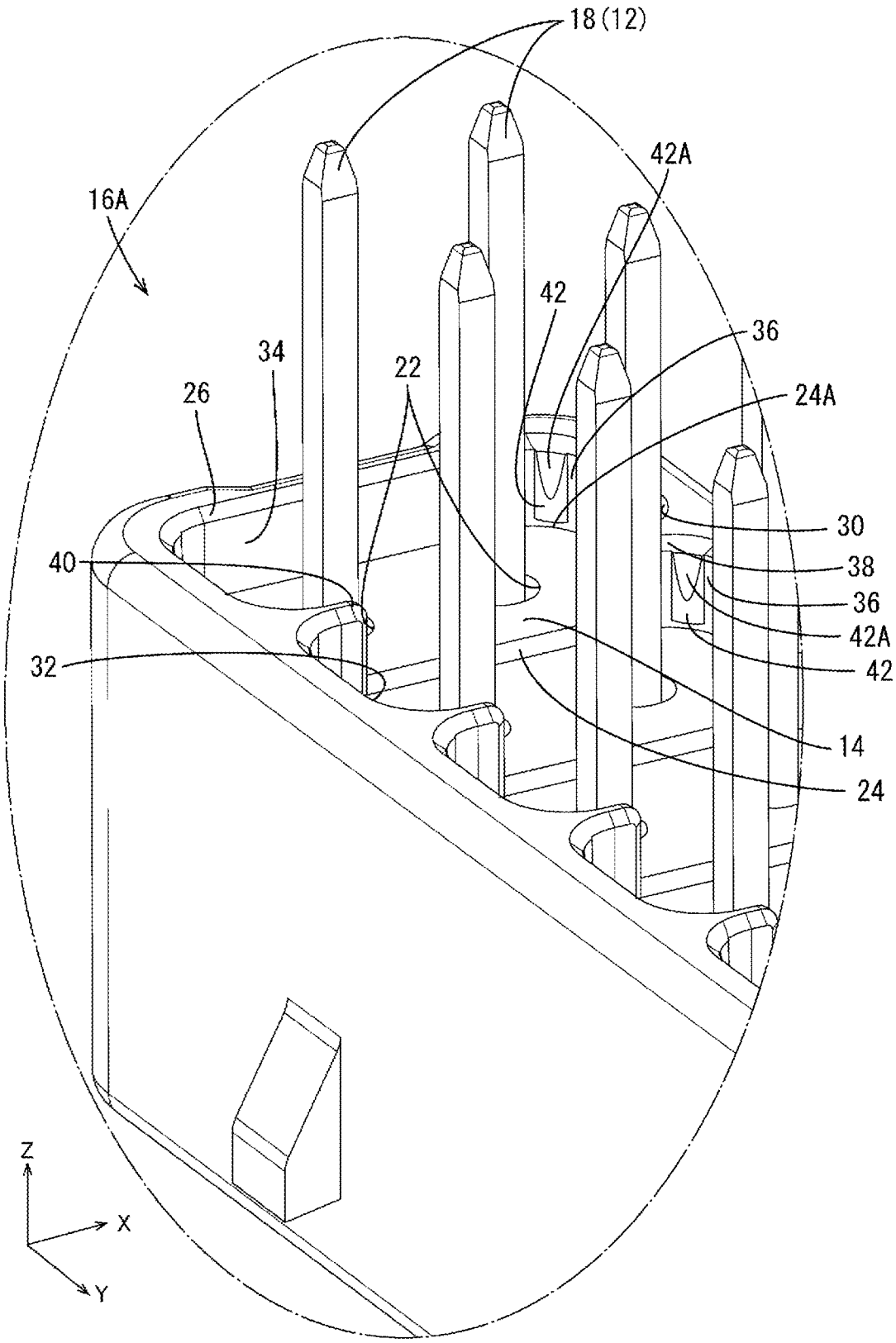
FIG. 4 is an enlarged view near the ferrites in FIG. 3.

As shown in FIGS. 3 and 5, a projection 42 is provided to project on an upper part of each facing wall portion 36, and the projection 42 is provided with a tapered portion 42A inclined toward an opening edge of the opening 26 of the inner housing 16 (see FIG. 4).

The ferrite 14 is accommodated into the inner housing 16A through the opening 26. In accommodating the ferrite 14, the ferrite 14 is accommodated in a somewhat press-fit state into the inner housing 16A while the corner portions 24A on the four corners of the ferrite 14 are biased by the four projections 42 provided on the facing wall portions 36 facing the respective corner portions 24A. At this time, since the projections 42 are provided with the tapered portions 42A inclined toward the opening edge of the inner housing 16A, the ferrite 14 is guided into the inner housing 16A while the corner portions 24A of the ferrite 14 slide on the tapered portions 42A. Thus, the ferrite 14 is easily accommodated.

Figure 7:
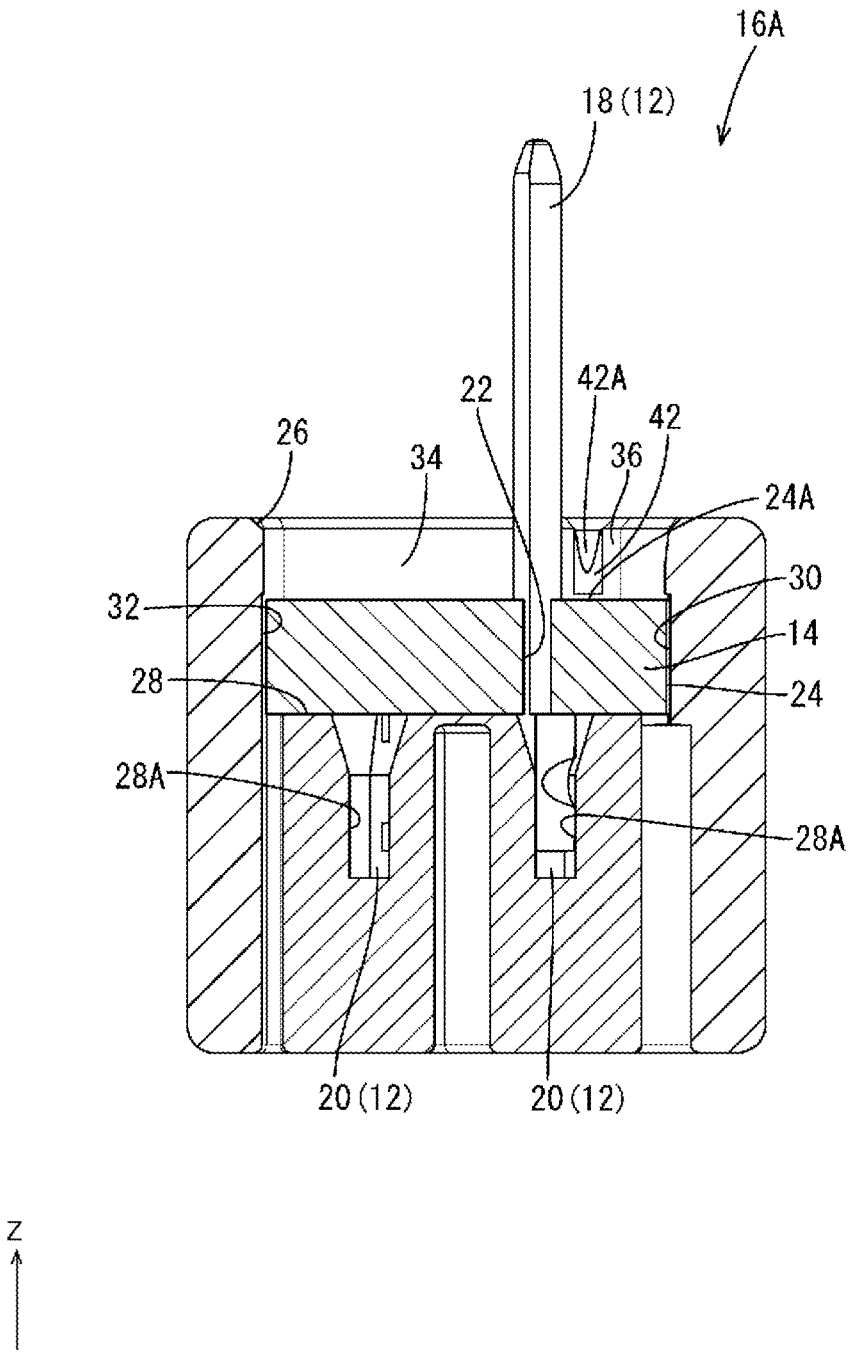
FIG. 7 is a section along 7-7 in FIG. 6.
Figure 8:
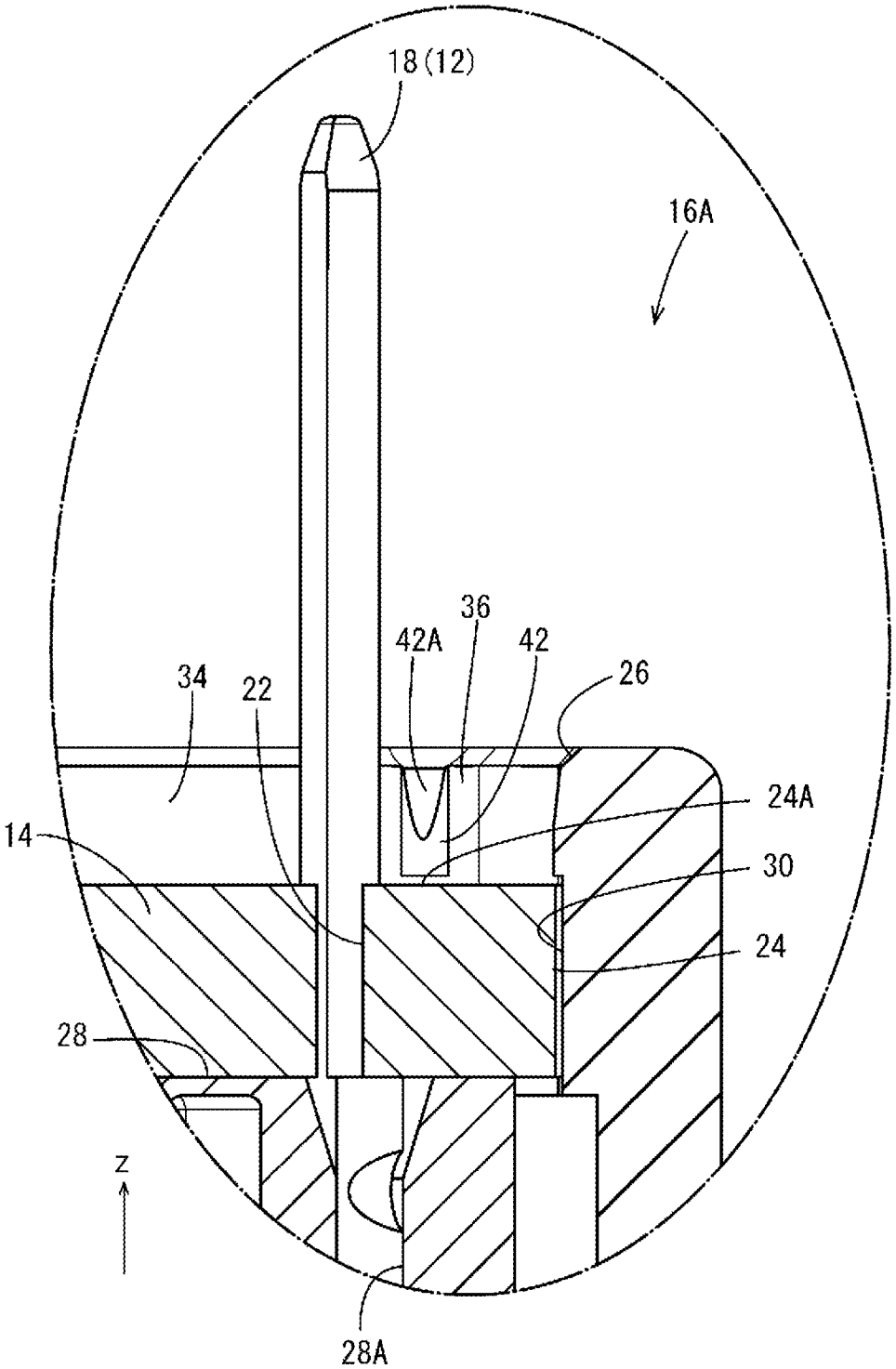
FIG. 8 is an enlarged view near a projection in FIG. 7.

When the ferrite 14 is accommodated into the inner housing 16A, the terminal body portions 18 of the different joint terminals 12 are respectively inserted into the two insertion holes 22 of the ferrite 14. At this time, as shown in FIGS. 7 and 8, the projections 42 are located slightly above the upper surface of the ferrite 14 and the ferrite 14 is accommodated inside the inner housing 16A without being biased by the projections 42. In this way, changes in properties of the ferrite 14 can be suppressed as compared to a configuration in which a ferrite is accommodated inside an inner housing while being biased by biasing arms as before.

As shown in FIGS. 7 and 8, with the ferrite 14 accommodated inside the inner housing 16A, the corner portions 24A of the ferrite 14 are located to be able to come into contact with the projections 42 from below. If the ferrite 14 is going to escape from the inner housing 16A, the upward escape of the ferrite 14 is suppressed by the contact of the corner portions 24A of the ferrite 14 with the projections 42 from below and the ferrite 14 can be held inside the inner housing 16A. Further, since the ferrite 14 is held inside the inner housing 16A by the four projections 42, the escape of the ferrite 14 from the inner housing 16A can be made less likely as compared to a configuration in which the projection 42 is provided only on one facing wall portion 36, out of the four facing wall portions 36 facing the corner portions 24A of the ferrite 14.

As described above, according to the first embodiment, the corner portions 24A of the ferrite 14 are located to be able to come into contact with the projections 42 in the vertical direction (first direction) when the ferrite 14 is accommodated in the inner housing (accommodating portion) 16A. Thus, if the ferrite 14 is going to escape from the inner housing (accommodating portion) 16A in the vertical direction (first direction), the ferrite 14 comes into contact with the projections 42, whereby the escape of the ferrite 14 in the vertical direction (first direction) can be suppressed and the ferrite 14 can be held in the inner housing (accommodating portion) 16A. In this way, although the ferrite is conventionally held in the inner housing by the resilient contact of the biasing arms with the ferrite, the ferrite 14 can be held in the inner housing (accommodating portion) 16A without using the biasing arms in the above configuration. Further, since the corner portions 24A of the ferrite 14 are not biased by the projections 42 with the ferrite 14 accommodated in the inner housing (accommodating portion) 16A, changes in the properties of the ferrite 14 can be suppressed.

Further, the projections 42 may be provided on all the four facing wall portions 36. By providing the projections 42 on all the four facing wall portions 36, the escape of the ferrite 14 from the inner housing (accommodating portion) 16A can be made less likely as compared with a configuration in which the projection 42 is provided only on one facing wall portion 36.

Further, the inner housing (accommodating portion) 16A may be in the form of a box open in the vertical direction (first direction) and long in the lateral direction (second direction) intersecting the vertical direction (first direction), the plurality of ferrites 14 may be disposed side by side in the lateral direction (second direction) on the bottom wall portion 28 of the inner housing (accommodating portion) 16A, the inner housing (accommodating portion) 16A may further include the first inner wall 30 and the second inner wall 32 facing in the front-rear direction (third direction) intersecting the vertical direction (first direction) and the lateral direction (second direction), and the facing wall portions 36 on the side of the first inner wall 30 and the facing wall portions 36 on the side of the second inner wall 32 facing the former facing wall portions 36 may not be connected. Since the pairs of facing wall portions 36 facing in the front-rear direction (third direction) are not connected, the housing 16 can be reduced in size in the lateral direction (second direction) as compared to a configuration in which facing wall portions are connected and adjacent ones of the ferrites 14 are partitioned by the facing wall portions.

Second Embodiment [Description of Second Embodiment of Present Disclosure]

Modes in a second embodiment of the present disclosure are listed and described.

(1) A connector of the present disclosure is provided with a plurality of ferrites, and a housing including a plurality of accommodating portions capable of individually accommodating the plurality of ferrites from a first direction, wherein the plurality of accommodating portions are disposed side by side in a second direction intersecting the first direction, and two intermediate walls are disposed between the accommodating portions adjacent in the second direction with a space defined therebetween in a third direction intersecting the first and second directions.

The ferrites disposed in the adjacent accommodating portions can be accommodated in the accommodating portions while being partitioned from each other by the intermediate walls. In this way, troubles caused by the mutual contact of the ferrites due to vibration or the like can be suppressed. Further, since the two intermediate walls are disposed with the space defined therebetween in the third direction, the connector can be reduced in size in the third direction and can be reduced in weight as compared to the case where the two intermediate walls are connected.

(2) Preferably, each of the plurality of accommodating portions includes two holding walls extending along the second direction, and each of the two holding walls includes a resiliently deformable resilient holding portion and the ferrite is held in the accommodating portion by being sandwiched by the resilient holding portions.

The ferrite can be held in the accommodating portion by being sandwiched by the resilient holding portions. Further, since deflection margins of the resilient holding portions are provided along the second direction in the case of providing the resilient holding portions on the intermediate walls, the connector may be enlarged in the second direction. However, since the resilient holding portions are provided on the holding walls extending along the second direction in the present disclosure, the enlargement of the connector in the second direction can be suppressed.

(3) Preferably, a joint terminal is provided which includes a plurality of connecting portions and a coupling portion coupling the plurality of connecting portions, each of the plurality of accommodating portions has a bottom wall intersecting the first direction, and an accommodation groove extending along the second direction and configured such that the coupling portion is accommodated therein is provided at a position corresponding to the space between the intermediate walls in the bottom walls.

Since the accommodation groove is provided at the position corresponding to the space between the intermediate walls, the joint terminal can be accommodated into the accommodation groove from the first direction. Since the joint terminal and the ferrites can be accommodated into the accommodating portions from the same direction in this way, an assembly operation of the connector can be made more efficient. Further, since the coupling portion contacts the bottom surface of the accommodation groove, a rear cover for retaining the joint terminal from behind in the first direction is unnecessary. Thus, the number of components of the connector can be reduced.

(4) End edges of the two intermediate walls on a side opposite to the bottom walls in the first direction are preferably disposed at the same height position as an end edge of the connector on the side opposite to the bottom walls or at a height position higher than the end edge on the opposite side.

When the joint terminal is accommodated into the accommodation groove from the first direction, the joint terminal can be guided into the accommodation groove by being caused to slide in contact with the end edges of the intermediate walls on the side opposite to the bottom walls in the first direction. In this way, a manufacturing process of the connector can be made more efficient. Further, also when the ferrite is accommodated into the accommodating portion from the first direction, the ferrite is guided into the accommodating portion by being caused to slide in contact with the end edges of the intermediate walls on the side opposite to the bottom walls in the first direction. In this way, the manufacturing process of the connector can be made even more efficient.

(5) Preferably, one of the two intermediate walls is connected to one of the two holding walls and extends along the third direction, and the other of the two intermediate walls is connected to the other of the two holding walls and extends along the third direction.

The strength of the intermediate walls can be improved as compared to the case where the intermediate walls are separated from the holding walls. In this way, the mutual contact of the ferrites disposed in the adjacent accommodating portions can be further suppressed.

[Details of Second Embodiment of Present Disclosure]

A connector 110 in a second embodiment of the present disclosure is described below with reference to the drawings (FIGS. 11 to 15). In the following description, an X direction shown in FIGS. 11 to 15 is referred to as a forward direction of a front-rear direction (third direction), a Y direction is referred to as a rightward direction of a lateral direction (second direction) and a Z direction is referred to as an upward direction of a vertical direction (first direction) as in the first embodiment.

[Connector 110]

Figure 12:
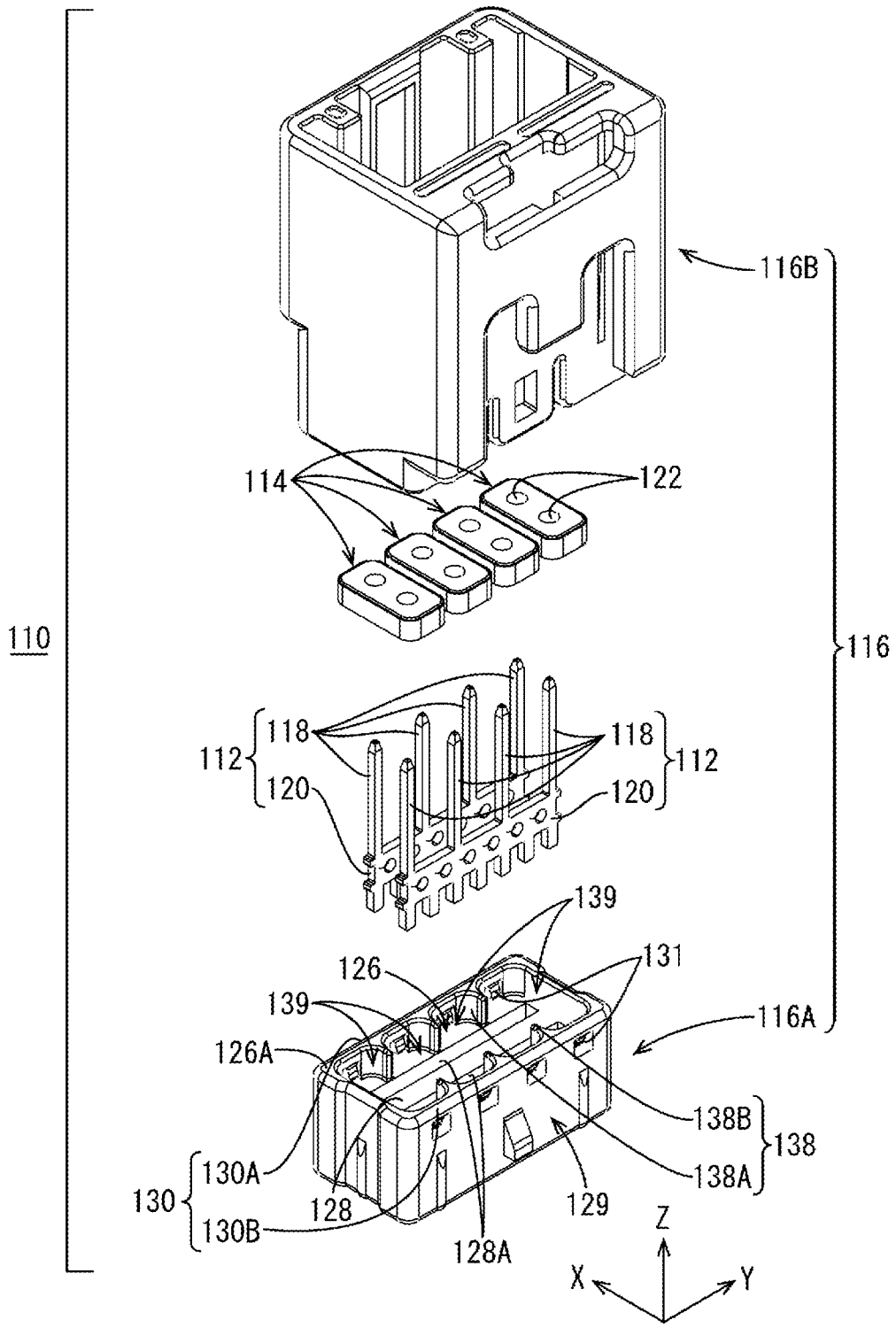
FIG. 12 is an exploded perspective view of the connector.

As shown in FIG. 12, the connector 110 includes two joint terminals 112, a plurality of (four) ferrites 114 for noise reduction and a housing 116.

[Joint Terminal 112]

The joint terminal 112 is made of conductive metal. As shown in FIG. 12, the joint terminal 112 includes four terminal body portions (connecting portions) 118 and a coupling portion 120. The terminal body portions 118 are in the form of bars projecting upward. The coupling portion 120 is shaped to be long in the lateral direction and connected to lower end parts of the plurality of terminal body portions 118. In this way, the plurality of terminal body portions 118 are coupled and electrically connected to each other.

[Ferrites 114]

As shown in FIG. 12, the ferrite 114 has a rectangular parallelepiped shape with rounded corners. Two insertion holes 122 are provided to penetrate through upper and lower surfaces of the ferrite 114. The terminal body portions 118 of the joint terminal 112 are inserted into the insertion holes 122 from below.

[Housing 116]

As shown in FIG. 12, the housing 116 includes an inner housing 116A and an outer housing 116B.

[Inner Housing 116A]

Figure 13:
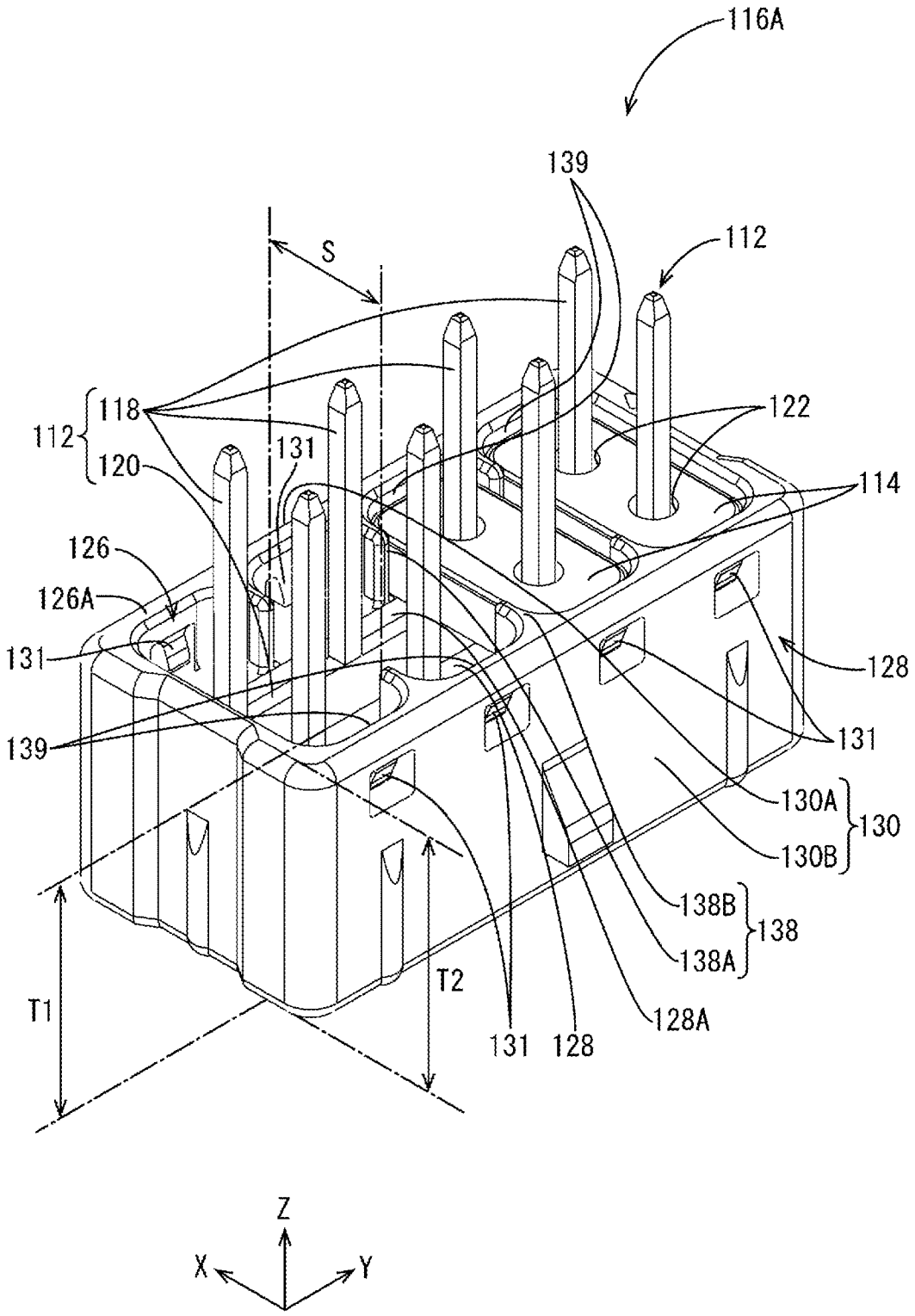
FIG. 13 is a perspective view of an inner housing in a state where two ferrites are accommodated.
Figure 14:
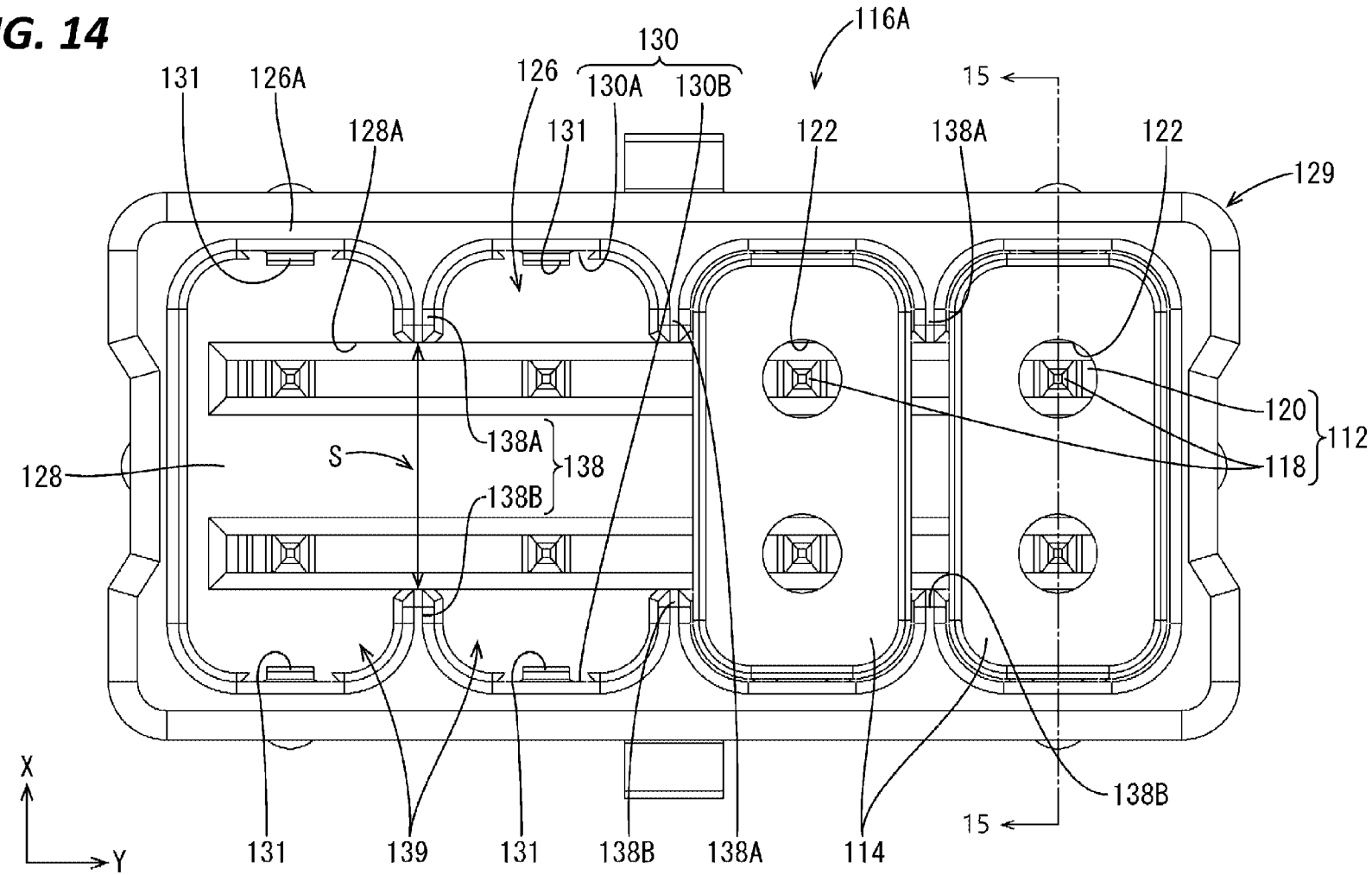
FIG. 14 is a plan view of the inner housing in the state where the two ferrites are accommodated.

As shown in FIG. 12, the inner housing 116A is in the form of a box having an opening 126 open upward and shaped to be long in the lateral direction. The inner housing 116A includes a bottom wall 128, a peripheral wall 129 extending upward from the outer peripheral edge of the bottom wall 128 and a plurality of intermediate walls 138. As shown in FIGS. 12 to 14, the four ferrites 114 and the two joint terminals 112 are accommodated into the inner housing 116A through the opening 126 (only two ferrites 114 are shown in FIGS. 13 and 14).

[Accommodating Portions 139]

As shown in FIG. 12, four accommodating portions 139 are formed in the inner housing 116A by the peripheral wall 129, the bottom wall 128 and the intermediate walls 138. The four accommodating portions 139 are disposed side by side in the lateral direction. The four ferrites 114 are individually accommodated into the four accommodating portions 139. Each accommodating portion 139 has a rectangular inner shape extending in the front-rear direction when viewed from above, and the inner shape thereof is the same as or somewhat larger than the outer shape of each ferrite 114.

[Peripheral Wall 129]

As shown in FIG. 12, an upper end part of the peripheral wall 129 serves as an opening edge 126A of the opening 126 of the inner housing 116A.

[Holding Walls 130, Resilient Holding Portions 131]

As shown in FIG. 12, parts of the peripheral wall 129 located in front of and behind the respective accommodating portions 139 serve as holding walls 130 each provided with resilient holding portions 131.

Figure 15:
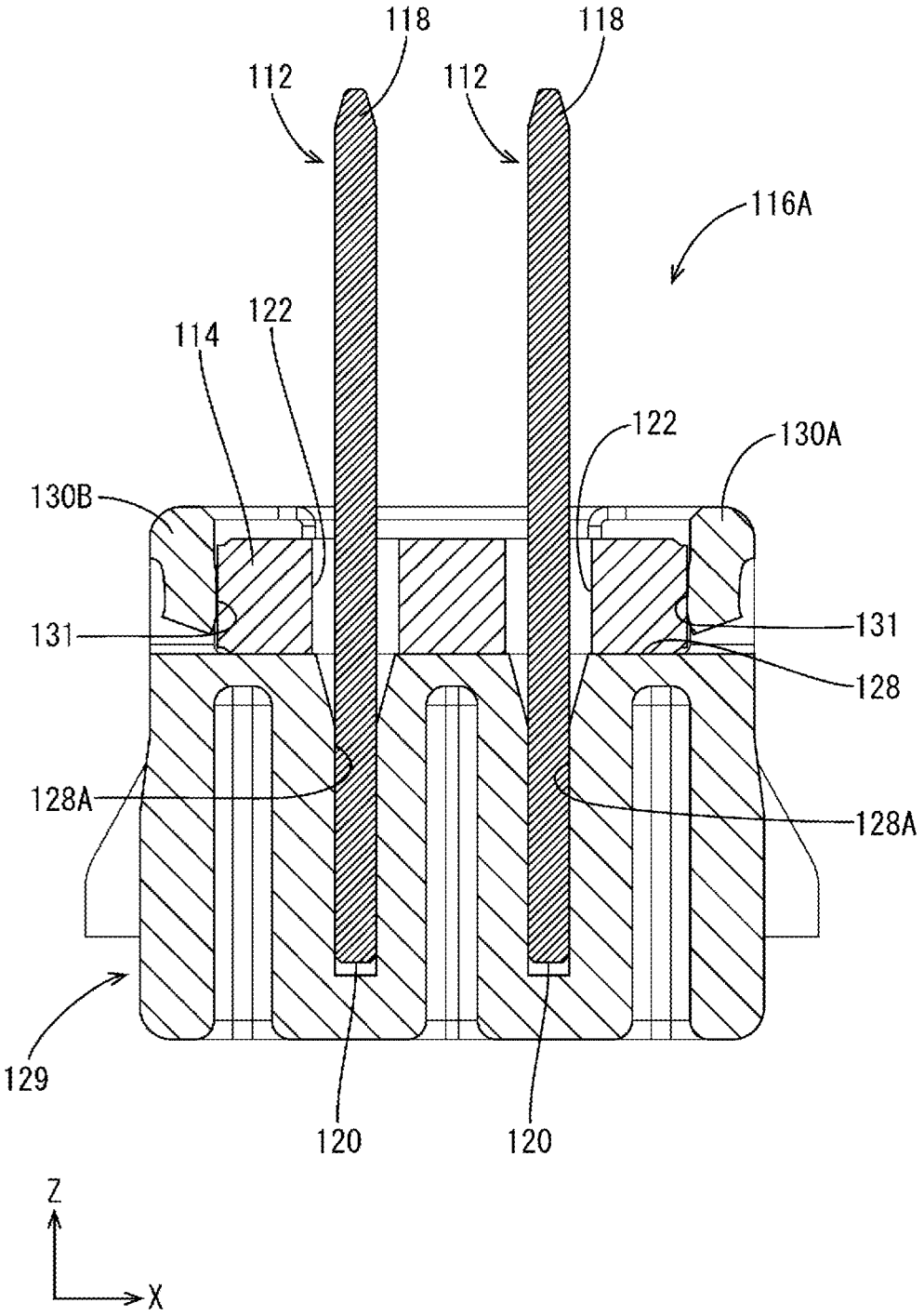
FIG. 15 is a section along 15-15 in FIG. 14.

As shown in FIGS. 12 to 14, a plurality of the resilient holding portions 131 are respectively provided at positions corresponding to side surfaces of the ferrites 114. The resilient holding portions 131 are resiliently deformable in the front-rear direction. As shown in FIG. 15, the ferrite 114 is held in the accommodating portion 139 by being sandwiched from front and behind by the front and rear resilient holding portions 131. By providing the resilient holding portions 131 on the holding walls 130 extending along the lateral direction, the enlargement of the connector 110 in the lateral direction can be suppressed, for example, as compared to a configuration in which the resilient holding portions 131 are provided on the intermediate walls 138 to be described later.

[Intermediate Walls 138]

As shown in FIGS. 12 to 14, the intermediate walls 138 are connected to each holding wall 130. The intermediate walls 138A provided on the front (one) holding wall 130A, out of the holding walls 130, extend toward gaps between adjacent ones of the ferrites 114 (see the intermediate wall 138 on a right end in FIGS. 13 and 14) from the front holding wall 130A in a state where the ferrites 114 are accommodated. Further, the intermediate walls 138B provided on the rear (other) holding wall 130B extend toward the gaps between adjacent ones of the ferrites 114 (see the intermediate wall 138 on the right end in FIGS. 13 and 14) from the rear holding wall 130B. As shown in FIGS. 13 and 14, a space S is defined in the front-rear direction between the intermediate walls 138A and 138B.

As shown in FIGS. 12 to 14, the intermediate walls 138 are located between the adjacent accommodating portions 139. The ferrites 114 disposed in the adjacent accommodating portions 139 are partitioned from each other by the intermediate walls 138 and accommodated in the accommodating portions 139. In this way, troubles caused by the mutual contact of the ferrites 114 due to vibration or the like can be suppressed. Further, since two intermediate walls 138 are disposed across the space S in the front-rear direction, the connector 110 can be reduced in size and reduced in weight as compared to the case where the two intermediate walls 138 are connected. Further, since the intermediate walls 138 are connected to the holding walls 130, the strength of the intermediate walls 138 can be improved as compared to the case where intermediate walls and holding walls are separated. In this way, the mutual contact of the ferrites 114 disposed in the adjacent accommodating portions 139 can be further suppressed.

[Bottom wall 128, Accommodation Grooves 128A]

As shown in FIGS. 12 and 13, the bottom wall 128 is provided in a lower part of the peripheral wall 129. The bottom wall 128 is provided with two accommodation grooves 128A. The accommodation grooves 128A extend along the lateral direction. The coupling portions 120 of the joint terminals 112 are press-fit and accommodated into the accommodation grooves 128A. The ferrite 114 is accommodated in the accommodating portion 139 with the joint terminals 112 accommodated in the accommodation grooves 128A. When being accommodated into the accommodating portion 139, the ferrite 114 is placed on the bottom wall 128.

As shown in FIGS. 13 and 14, the accommodation grooves 128A are provided at positions corresponding to the space S between the intermediate walls 138. In this way, the joint terminals 112 can be accommodated into the accommodation grooves 128A through the opening 126 located above. Thus, the joint terminals 112 and the ferrites 114 can be accommodated into the accommodating portions 139 in the same direction (from the side of the opening 126), and an assembly operation of the connector 110 can be made more efficient, for example, as compared to a configuration in which ferrites are accommodated into an inner housing from above and joint terminals are accommodated into the inner housing from below. Further, in the case of accommodating the joint terminals into the inner housing from below, a rear cover for retaining the joint terminals from below is generally necessary. However, since the coupling portions 120 are in contact with the bottom surfaces of the accommodation grooves 128A in the second embodiment, a rear cover for retaining the joint terminals 112 from below is unnecessary. Therefore, the number of components of the connector 110 can be reduced.

As shown in FIG. 13, a height position T1 of the intermediate walls 138 (intermediate walls 138A, 138B) and a height position T2 of the opening edge 126A (i.e. height position of an end edge on a side opposite to the bottom wall 128) are the same height position. In this way, when the joint terminal 112 is accommodated into the accommodation groove 128A from above, the joint terminal 112 is guided into the accommodation groove 128A by being caused to slide in contact with the upper end edges of the intermediate walls 138. Thus, a manufacturing process of the connector 110 can be made more efficient. Further, also in accommodating the ferrite 114 into the accommodating portion 139 from above, the ferrite 114 is guided into the accommodating portion 139 by being caused to slide in contact with the upper end edges of the intermediate walls 138. In this way, the manufacturing process of the connector 110 can be made even more efficient.

Other Embodiments

The technique disclosed by this specification is not limited to the above described and illustrated embodiments. For example, the following modes are also included.

(1) Although the projections 42 are respectively provided on the four facing wall portions 36 facing the corner portions 24A on the four corners of the ferrite 14 in the first embodiment, a projection may be provided only on any one of the facing wall portions.

(2) Although the first partitioning portions 38 (and facing wall portions 36 provided on the first partitioning portions 38) and the second partitioning portions 40 (and facing wall portions 36 provided on the second partitioning portions 40) facing in the front-rear direction are not connected and the adjacent accommodation spaces for the ferrites 14 communicate in the lateral direction in the first embodiment, first and second partitioning portions may be connected and adjacent accommodation spaces for ferrites may not communicate.

(3) Although six ferrites 14 are accommodated into the inner housing 16A in the first embodiment, the number of the ferrites 14 may be less than six or more than six. Further, although four ferrites 114 are accommodated into the inner housing 116A in the second embodiment, the number of the ferrites 114 may be less than four or more than four.

(4) Although the intermediate walls 138 are connected to the holding walls 130 in the second embodiment, there is no limitation to this. For example, intermediate walls may be separated from the holding walls without being connected thereto.

(5) Although the height position T1 of the intermediate walls 138 and the height position T2 of the opening edge 126A of the opening 126 are the same height position in the second embodiment, there is no limitation to this. For example, a height position of intermediate walls may be lower than or higher than a height position of an opening edge of an opening.

LIST OF REFERENCE NUMERALS

10: connector
12: joint terminal
14: ferrite
16: housing
16A: inner housing (accommodating portion)
16B: outer housing
18: terminal body portion
20: coupling portion
22: insertion hole
24: outer peripheral side surface
24A: corner portion
26: opening
28: bottom wall portion
28A: groove portion
30: first inner wall

32: second inner wall
34: third inner wall
36: facing wall portion
38: first partitioning portion
40: second partitioning portion
42: projection
42A: tapered portion
110: connector
112: joint terminal
114: ferrite
116: housing
116A: inner housing
116B: outer housing
118: terminal body portion (connecting portion)
120: coupling portion
122: insertion hole
126: opening
126A: opening edge
128: bottom wall
128A: accommodation groove
129: peripheral wall
130: holding wall
130A: holding wall
130B: holding wall
131: resilient holding portion
138, 138A, 138B: intermediate wall
139: accommodating portion
S: space
T1: height position
T2: height position

What is claimed is:

1. A connector comprising:

a plurality of ferrites; and a housing including a plurality of accommodating portions capable of individually accommodating the plurality of ferrites from a first direction, wherein:

the plurality of accommodating portions are disposed side by side in a second direction intersecting the first direction, two intermediate walls are disposed between the accommodating portions adjacent in the second direction and spaced apart from each other to form a space defined therebetween in a third direction intersecting the first and second directions, each of the plurality of ferrites includes rounded corner portions on four corners of an outer peripheral side surface, an accommodating portion of the plurality of accommodating portions includes:

a bottom wall portion on which the ferrite is placed, four facing wall portions facing the four corner portions of the ferrite, and a projection for holding the ferrite in the accommodating portion, the projection projects on at least one facing wall portion, out of the four facing wall portions, and the corner portion of the ferrite is biased by the projection when the ferrite is accommodated into the accommodating portion, and is not biased by the projection and located to be able to come into contact with the projection from the first direction in a state where the ferrite is accommodated in the accommodating portion.

2. The connector of claim 1, wherein:

each of the plurality of accommodating portions includes two holding walls extending along the second direction, and each of the two holding walls includes a resiliently deformable resilient holding portion and the ferrite is held in the accommodating portion by being sandwiched by the resilient holding portions.

3. The connector of claim 2, comprising a joint terminal including a plurality of connecting portions and a coupling portion coupling the plurality of connecting portions, wherein:

each of the plurality of accommodating portions has a bottom wall intersecting the first direction, and an accommodation groove extending along the second direction and configured such that the coupling portion is accommodated therein is provided at a position corresponding to the space between the intermediate walls in the bottom walls.

4. The connector of claim 3, wherein end edges of the two intermediate walls on a side opposite to the bottom walls in the first direction are disposed at the same height position as an end edge of the connector on the side opposite to the bottom walls or at a height position higher than the end edge on the opposite side.

5. The connector of claim 2, wherein one of the two intermediate walls is connected to one of the two holding walls and extends along the third direction, and the other of the two intermediate walls is connected to the other of the two holding walls and extends along the third direction.

6. The connector of claim 1, wherein the projections are provided on all the four facing wall portions.

7. The connector of claim 1, wherein:

the accommodating portion is in the form of a box open in the first direction and long in a second direction intersecting the first direction, the plurality of ferrites are disposed side by side in the second direction on the bottom wall portions of the accommodating portions, the accommodating portion further includes a first inner wall and a second inner wall facing in a third direction intersecting the first and second directions, and the facing wall portions on the first inner wall side and the facing wall portions on the second inner wall side facing the former facing wall portions are not connected.

8. The connector of claim 1, wherein the accommodating portions adjacent in the second direction communicate in the second direction.

9. The connector of claim 1, wherein the first direction is a vertical direction of the housing.

* * * * *